US011376466B2

(12) United States Patent
Hume et al.

(10) Patent No.: US 11,376,466 B2
(45) Date of Patent: Jul. 5, 2022

(54) AB EXERCISE DEVICE

(71) Applicant: HIGH STREET TV (GROUP) LIMITED, Harrogate (GB)

(72) Inventors: Josh Hume, Huddersfield (GB); Luke Modeste, Harrogate (GB)

(73) Assignee: HIGH STREET TV (GROUP) LIMITED, North Yorkshire (GB)

( * ) Notice: Subject to any disclaimer, the term of this patent is extended or adjusted under 35 U.S.C. 154(b) by 145 days.

(21) Appl. No.: 16/604,186

(22) PCT Filed: Aug. 22, 2019

(86) PCT No.: PCT/EP2019/072458
§ 371 (c)(1),
(2) Date: Oct. 10, 2019

(87) PCT Pub. No.: WO2020/078605
PCT Pub. Date: Apr. 23, 2020

(65) Prior Publication Data

US 2021/0331033 A1 Oct. 28, 2021

(30) Foreign Application Priority Data

Oct. 18, 2018 (GB) ..... 1816946

(51) Int. Cl.
*A63B 23/02* (2006.01)
*A63B 21/00* (2006.01)
(Continued)

(52) U.S. Cl.
CPC ..... *A63B 23/0222* (2013.01); *A63B 21/0428* (2013.01); *A63B 21/0557* (2013.01);
(Continued)

(58) Field of Classification Search
CPC ..... A63B 21/00058; A63B 21/00061; A63B 21/00069; A63B 21/00178;
(Continued)

(56) References Cited

U.S. PATENT DOCUMENTS 2,223,309 A * 11/1940 Swanson ..... A63B 21/4035 482/123
3,228,392 A * 1/1966 Speyer ..... A61H 23/0218 601/108
(Continued)

FOREIGN PATENT DOCUMENTS

CN 107998607 A 5/2018
GB 2559125 8/2018
(Continued)

OTHER PUBLICATIONS

British Combined Search and Examination Report, dated Mar. 19, 2019, from corresponding/related British Application No. 1816946.6.
(Continued)

*Primary Examiner* — Gary D Urbiel Goldner
(74) *Attorney, Agent, or Firm* — Nixon & Vanderhye

(57) ABSTRACT

An ab exercise device including a first tube member, a second tube member movable with respect to the first tube member, an elastic member resisting a downward movement of the second tube member and moving the second tube member upward with respect to the first tube member, a first and a second side part for supporting the ab exercise device respectively against a first and a second surface, the first and the second side part being arranged respectively to a first and a second side of the first tube member in an upper end of the first tube member, and a top part for pressing down the second tube member, the top part being attached to the second tube member.

13 Claims, 5 Drawing Sheets

(51) Int. Cl.
*A63B 21/04* (2006.01)
*A63B 21/055* (2006.01)
*A63B 23/035* (2006.01)

(52) U.S. Cl.
CPC ..... *A63B 21/4035* (2015.10); *A63B 21/4045* (2015.10); *A63B 23/03525* (2013.01)

(58) Field of Classification Search
CPC ..... A63B 21/00181; A63B 21/00185; A63B 21/002; A63B 21/0023; A63B 21/008; A63B 21/0083; A63B 21/0085; A63B 21/0087; A63B 21/02; A63B 21/023; A63B 21/025; A63B 21/026; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/068; A63B 21/15; A63B 21/151; A63B 21/4027; A63B 21/4033; A63B 21/4035; A63B 21/4045; A63B 2023/003; A63B 23/02; A63B 23/0205; A63B 23/0211; A63B 23/0222; A63B 23/035; A63B 23/03516; A63B 23/03525; A63B 2208/0228; A63B 2208/0233; A63B 2208/0238; A63B 2210/00; A63B 2210/50; A63B 2210/58; A63B 2225/09; A63B 2225/093
See application file for complete search history.

(56) References Cited

U.S. PATENT DOCUMENTS 4,390,178 A * 6/1983 Rudell ..... A63B 25/08 482/77
4,863,162 A * 9/1989 Neckamm ..... A63B 21/05 482/128
5,046,726 A * 9/1991 Van Straaten ..... A63B 21/05 482/125
5,069,448 A * 12/1991 Shyu ..... A63B 21/0087 482/112
5,154,685 A * 10/1992 Chen ..... A63B 21/00043 482/121
5,160,304 A * 11/1992 Van Der Hoeven ..... A63B 21/0004 482/121
5,232,425 A 8/1993 Miller et al.
5,462,518 A * 10/1995 Hatley ..... A61F 5/024 482/124
5,637,066 A * 6/1997 Chang ..... A63B 21/0004 482/121
5,695,436 A 12/1997 Huang
5,700,232 A * 12/1997 Clausen ..... A63B 21/0552 482/125
5,746,686 A 5/1998 Berman et al.
5,820,520 A * 10/1998 Sieber ..... A63B 23/12 482/34
D403,163 S * 12/1998 Lipps ..... D21/692
5,911,535 A * 6/1999 Gvoich ..... A63B 23/0211 482/124
5,913,756 A * 6/1999 Glaser ..... A63B 23/03525 482/128
5,954,622 A * 9/1999 Olschansky ..... A63B 21/4011 482/123
6,077,205 A * 6/2000 Zarillo ..... A63B 23/0211 482/121
6,193,638 B1 * 2/2001 Barrett ..... A63B 21/0004 482/128
6,206,811 B1 * 3/2001 Lat ..... A63B 21/0004 482/126
6,248,047 B1 * 6/2001 Abdo ..... A63B 21/023 482/121
7,115,079 B2 * 10/2006 Yu ..... A63B 23/0211 482/126
7,569,003 B1 * 8/2009 Huffman ..... A63B 23/0355 482/112
8,002,683 B1 * 8/2011 Nayebdadash .... A63B 23/0227 482/140
8,092,354 B2 * 1/2012 Oller, Jr. ..... A63B 21/4047 482/131
D682,375 S * 5/2013 Wu ..... D21/692
8,545,421 B2 * 10/2013 Wu ..... A61H 7/007 601/46
9,119,986 B2 * 9/2015 Colby ..... A63B 21/4035
9,205,297 B2 * 12/2015 Kaehler ..... A63B 23/03525
10,413,771 B1 * 9/2019 Del Conte ..... A63B 21/05
2001/0019987 A1 * 9/2001 Conner ..... A63B 23/0211 482/122
2002/0111252 A1 * 8/2002 Gault ..... A63B 23/0211 482/111
2003/0125171 A1 * 7/2003 He ..... A63B 21/0004 482/126
2003/0162638 A1 * 8/2003 Verheem ..... A63B 21/05 482/123
2003/0181297 A1 9/2003 Suiter
2004/0132593 A1 * 7/2004 Yauger ..... A63B 23/03525 482/128
2004/0171466 A1 * 9/2004 Tuller ..... A63B 21/0023 482/140
2005/0255974 A1 * 11/2005 Gault ..... A63B 21/00069 482/111
2006/0052225 A1 * 3/2006 Stearns ..... A63B 21/00072 482/140
2006/0089240 A1 4/2006 Yu
2007/0197356 A1 * 8/2007 Miller ..... A63B 21/0087 482/112
2008/0090706 A1 * 4/2008 Boland ..... A63B 21/00185 482/126
2008/0167167 A1 * 7/2008 Munoz ..... A63B 21/05 482/121
2012/0115693 A1 * 5/2012 Franques ..... A63B 21/4015 482/140
2013/0005542 A1 1/2013 Wu et al.
2013/0029814 A1 * 1/2013 D'Alessandro .... A63B 23/0227 482/139
2013/0157822 A1 * 6/2013 Wu ..... A63B 21/0414 482/139
2013/0190149 A1 * 7/2013 Carraway ..... A63B 23/02 482/140
2013/0281272 A1 * 10/2013 Payne ..... A63B 21/023 482/140
2013/0316882 A1 * 11/2013 Param ..... A63B 21/4013 482/125
2013/0324376 A1 12/2013 Colby
2014/0011646 A1 1/2014 Wu
2015/0375031 A1 * 12/2015 Tong ..... A63B 21/05 482/128
2016/0228740 A1 8/2016 Castelluccio
2019/0022459 A1 * 1/2019 Hoeven ..... G16H 20/30
2020/0001128 A1 * 1/2020 Hume ..... A63B 23/0405

FOREIGN PATENT DOCUMENTS

MX 2014001845 A 8/2015
WO 2006/105554 A1 10/2006

OTHER PUBLICATIONS

Examination Report under Section 18(3) issued in British Patent Application No. GB1816946.6 dated Apr. 27, 2021.
International Search Report and Written Opinion, dated Nov. 29, 2019, from corresponding/related International Application No. PCT/EP2019/072458.

* cited by examiner

AB EXERCISE DEVICE

FIELD OF THE INVENTION

Generally the present invention relates to exercise devices. In particular, the present invention pertains to ab exercise devices.

BACKGROUND

Typically, ab exercise devices require the user to be in an uncomfortable position, for example on the floor on their back, or on an incline on their front.

Those ab exercise devices which do allow the user to adopt a comfortable position (e.g. seated) do not offer adequate range of motion for full concentric and eccentric (i.e. shortening and lengthening) contractions.

As well as being an important muscle group for functional strength and a stable foundation, the abs in particular are sought after by many for aesthetic confidence.

There are a large number of products that assert to engage core muscles when actually they assist the movement, reducing the muscle activation, and therefore reducing the effect. For example, many devices let the user to firmly grip the device with their hands so that the focus shifts from ab to arm strength to carry out the movement.

One efficient and widely known ab exercise movement is the crunch movement or sit-up movement. A crunch is executed by a person contracting their rectus abdominis (abs) so that their rib cage is pulled towards their pelvis. This can be done lying down (most commonly), hanging from a bar or sat down.

Carried out incorrectly, the crunch can cause lower back issues, particularly in the lying down position.

SUMMARY OF THE INVENTION

The objective is to at least alleviate the problems described hereinabove not satisfactorily solved by the known arrangements, and to provide a feasible ab exercise device. One objective is to discourage the use of arms to carry out the exercise motion so that there is more focus on the abs. Another objective is to provide greater range of motion. A third objective is to provide different levels of resistance. A fourth objective is to provide a rotatable top part that enables the user to carry out twisted crunches. A fifth objective is to provide rotating side parts that position the user in a comfortable movement direction. A sixth objective is to utilize elastic members, such as resistance bands, that may provide progressive resistance so that the elongation of the bands increases the resistance gradually.

The aforesaid objectives are achieved by the embodiments of an ab exercise device in accordance with the present invention.

The aforesaid objectives are achieved according to the present invention as claimed in claim 1.

Accordingly, in one aspect of the present invention an ab exercise device comprises

- a first tube member,
- a second tube member movable with respect to the first tube member,
- an elastic member resisting a downward movement of the second tube member and moving upward the second tube member upward with respect to the first tube member,
- a first and a second side part for supporting the ab exercise device respectively against a first and a second surface, the first and the second side part being arranged respectively to a first and a second side of the first tube member in an upper end of the first tube member, and
- a top part for pressing down the second tube member, the top part being attached to the second tube member.

In one embodiment the elastic member is a resistance band.

In one embodiment first and second ends of the resistance band to be attached respectively to first and second attachment points on the outside of the first tube member, the resistance band perforates the first tube member on higher locations than said first and second attachment points or the resistance band goes around the edges of the first tube member, and the resistance band perforates or goes around the second tube member in the lower end of the second tube member.

In one embodiment the first and second tube members have a rectangle-like shape comprising opposite first and second sides and opposite third and fourth sides.

In one embodiment the first and second sides form the longer side of the rectangle-like shape.

In one embodiment the ab exercise device comprises at least two resistance bands.

In one embodiment two resistance bands are arranged in parallel, the two resistance bands being attached to the first and second side of the first tube member.

In one embodiment the ab exercise device comprises a plurality of said first and/or second attachment points on different heights such that the resistance can be changed.

In one embodiment the ab exercise device comprises at least three first and second attachment points.

In one embodiment the first tube member is the lower tube member.

In one embodiment the first and second side parts are rotatable such that the movement direction is adjustable.

In one embodiment the first and second side parts comprise respectively a first and second side pad suitable for supporting against the thighs of a user.

In one embodiment the top part is rotatable such that the device is suitable for twisted ab movement.

In one embodiment the height of the top part is adjustable.

In one embodiment the top part forms a planar surface such that arms may be placed on top of the top part.

In one embodiment the top part is a handle comprising a first and second loop.

The utility of the present invention follows from a plurality of factors depending on each particular embodiment. Some embodiments of the present invention may discourage the use of arms to carry out the exercise motion, meaning more focus on abs. Some embodiments may provide different levels of resistance which may be adjustable by the user. Some embodiments may provide a rotatable top part that enables the user to carry out twisted crunches, which may engage obliques and transverse abdominis. Some embodiments may provide rotating side parts, preferably freely-rotating side parts that position the user in a comfortable movement direction. Some embodiments may provide great range of motion by arranging the first and second side parts in the upper end of the first tube member. Some embodiments may use elastic members, such as resistance bands, that may provide progressive resistance so that the elongation of the bands increases the resistance gradually. Some embodiments with a rectangle-like shape may allow a narrow width suitable for placing between the thighs of the user. Some embodiments with a rectangle-like shape with flat faces may make reinforcing the side part connection points structurally suitable.

The expression "a number of" refers herein to any positive integer starting from one (1), e.g. to one, two, or three.

The expression "a plurality of" refers herein to any positive integer starting from two (2), e.g. to two, three, or four.

Different embodiments of the present invention are disclosed in the dependent claims.

BRIEF DESCRIPTION OF THE RELATED DRAWINGS

Next the invention is described in more detail with reference to the appended drawings in which FIG. 1*a-c* illustrates an embodiment of an ab exercise device in accordance with the present invention in three different positions.

FIG. 2*a-c* illustrates a side view of an embodiment of an ab exercise device in accordance with the present invention in three different positions.

Figure 5A:
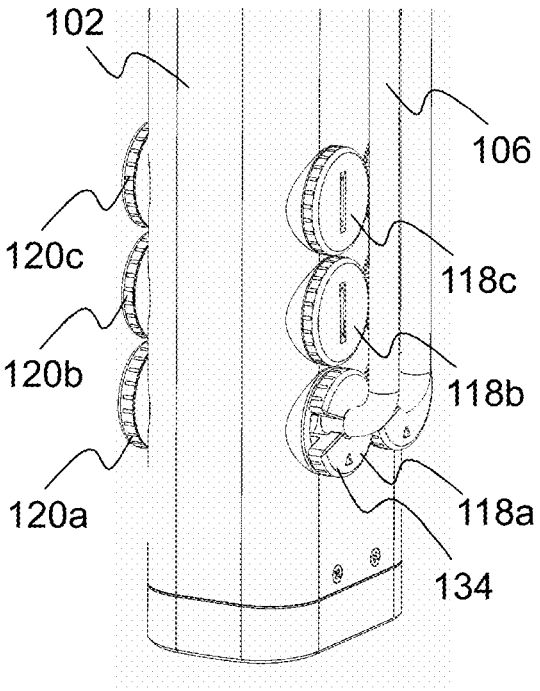
Figure 5B:
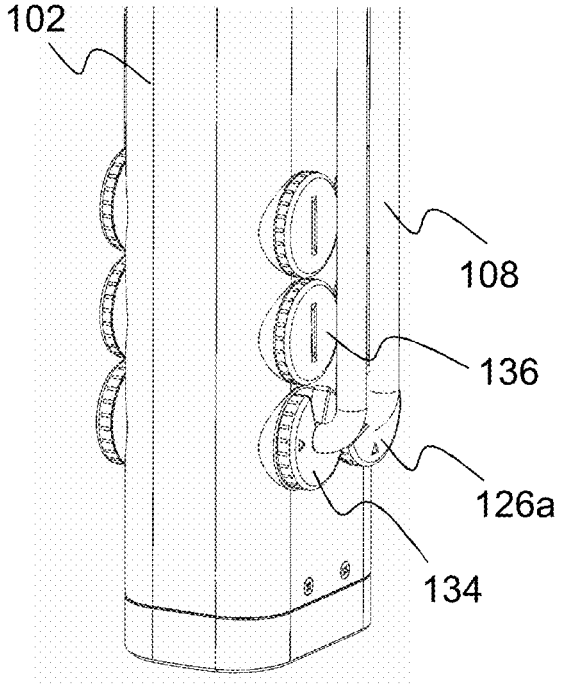
Figure 5C:
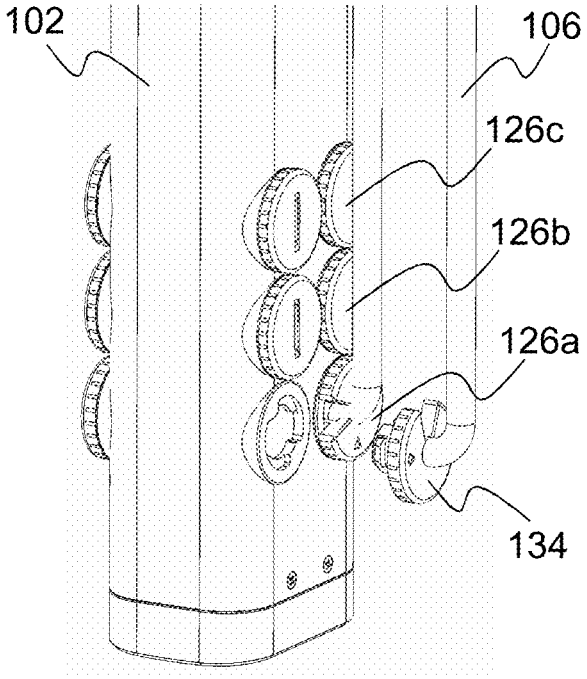

FIG. 5*a-c* illustrates an embodiment of the attachment points on the outside of the first tube member in accordance with the present invention.

Figure 6A:
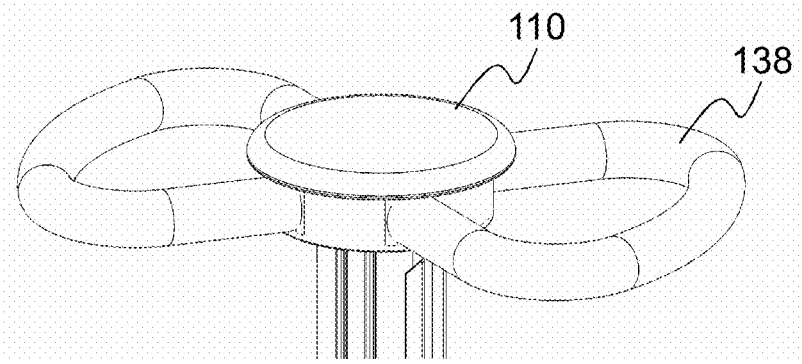
Figure 6B:
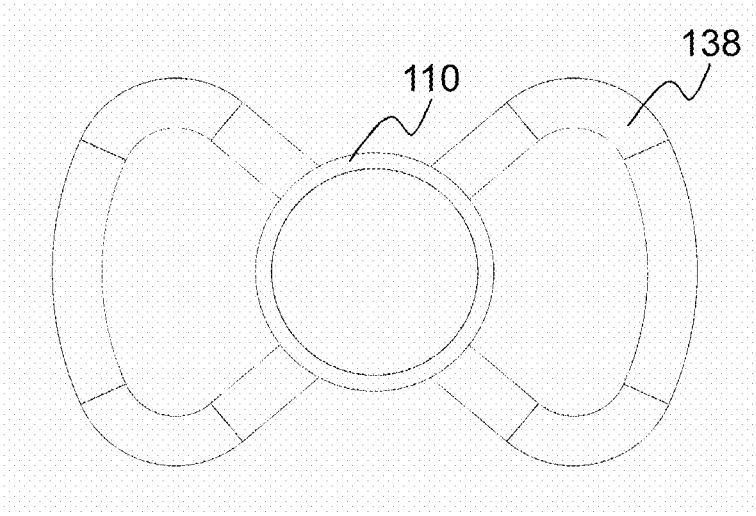

FIG. 6*a-b* illustrates two views of an embodiment of the top part in accordance with the present invention.

DETAILED DESCRIPTION OF THE EMBODIMENTS

Figure 1A:
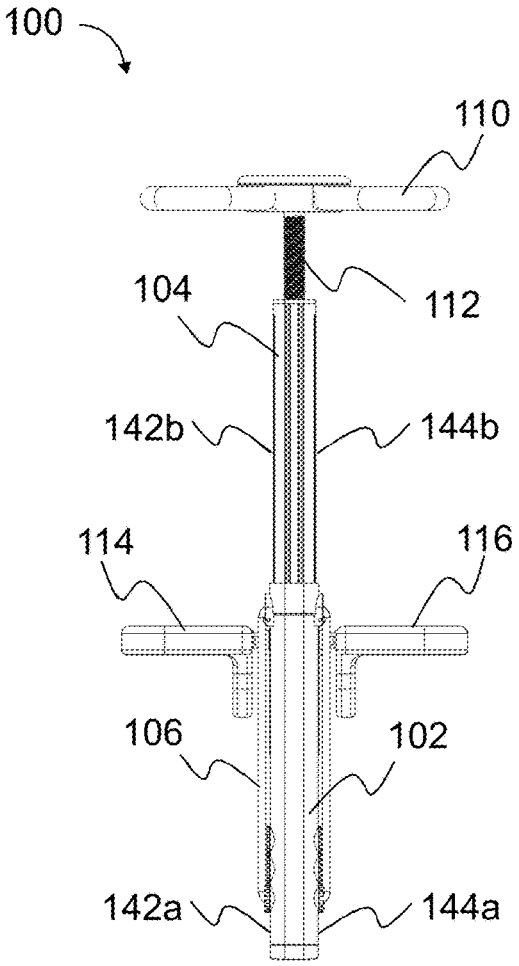
Figure 1B:
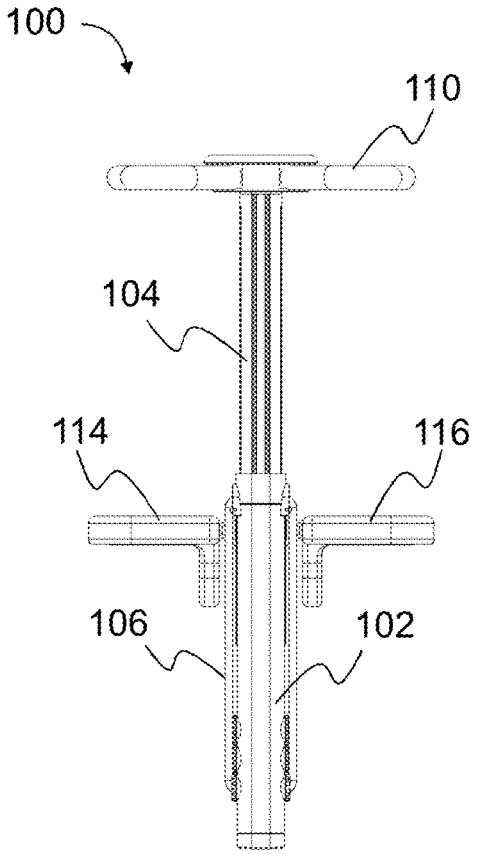
Figure 1C:
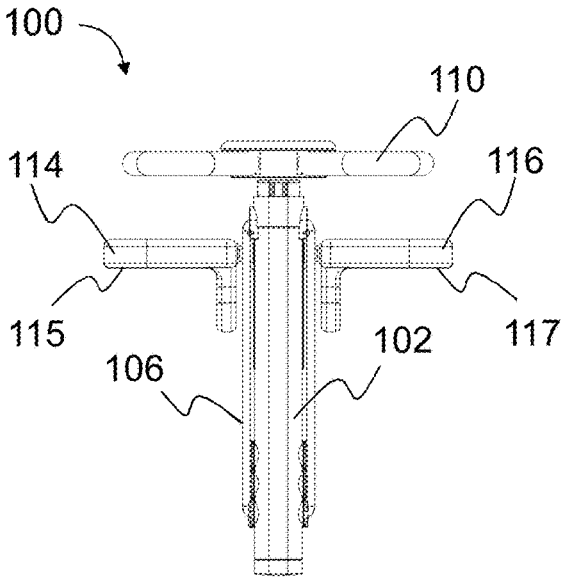

Referring to FIGS. 1*a-c*, the ab exercise device 100 comprises a first tube member 102 and a second tube member 104. The second tube member 104 is arranged within the first tube member 102 such that the second tube member 104 is movable with respect to the first tube member 102. The first and second tube members may be plastic, for example.

Figure 2A:
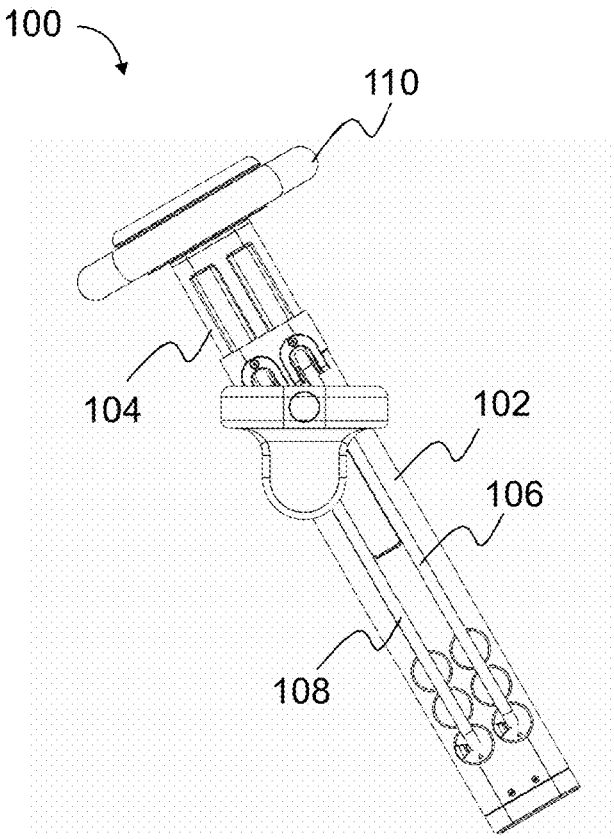
Figure 2B:
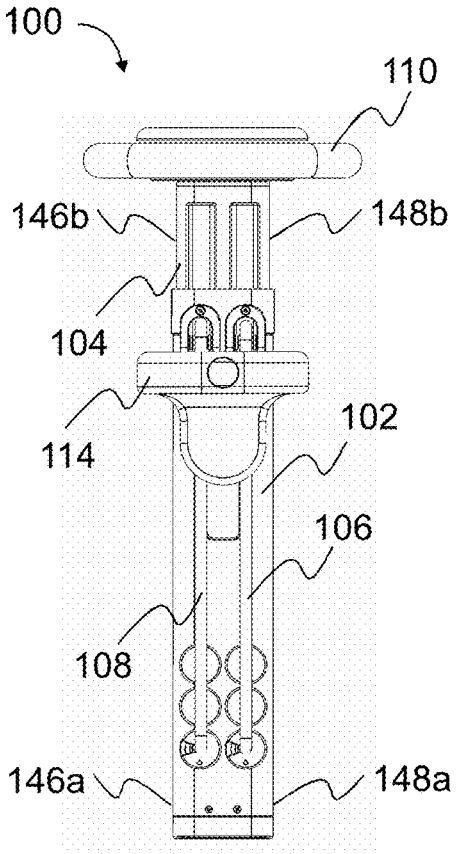
Figure 2C:
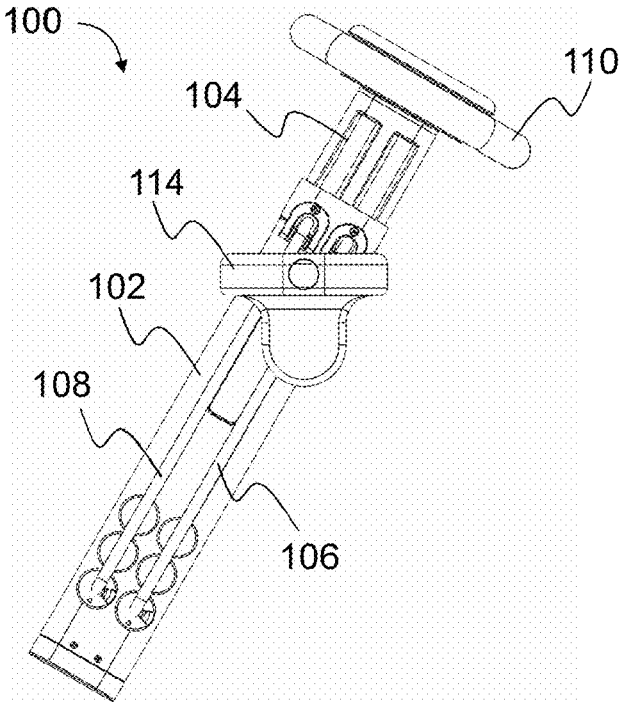

Referring also to FIGS. 2*a*-2*c*, the ab exercise device 100 comprises a first and a second elastic member 106, 108. The elastic members push the second tube member 104 upwards, simultaneously resisting the downward movement. The user may press the second tube member downwards. The range of motion is preferably 15-45 cm, more preferably 20-40 and most preferably 25-35 cm. In one preferable embodiment the range of motion is 32 cm.

The first and second tube members 102, 104 have a rectangle-like shape. The first tube member 102 comprises opposite first and second sides 142*a*, 144*a* and opposite third and fourth sides 146*a*, 148*a*. The second tube member 104 comprises opposite first and second sides 142*b*, 144*b* and opposite third and fourth sides 146*b*, 148*b*. The first and second sides 142*a*, 142*b*, 144*a*, 144*b* form the longer side of the rectangle-like shape. The width of the first and second sides 142*a*, 144*a* of the first tube member 102 is preferably 50-400 mm, more preferably 60-200 mm and most preferably 80-120 mm. The width of the third and fourth sides 146*a*, 148*a* of the first tube member is preferably 40-200 mm, more preferably 50-100 mm and most preferably 50-70 mm. In one preferable embodiment the width of the first and second sides 142*a*, 144*a* of the first tube member 102 is 102.6 mm and the width of the third and fourth sides 146*a*, 148*a* of the first tube member 102 is 57.6 mm.

A top part 110 is connected to the second tube member 104. The height of the top part 110 is adjustable for adjusting the height of the exercise device 100. The top part may comprise threads 112 for adjusting the height. In FIG. 1*a*, the top part is illustrated in its upper position whereas in FIGS. 1*b* and 1*c* the top part is illustrated in its lower position.

The user may place his/her arms on top of the device, preferably crossing the arms so that the first arm is against the top part and the second arm is on top of the first arm or next to the first arm. The user may then press down the top part of the device.

In FIGS. 1*a* and 1*b*, the exercise device 100 is illustrated in its upper starting position. In FIG. 1*c*, the exercise device 100 is illustrated in its lower position.

The exercise device may also be locked in to the lower position so that the device takes less storage space.

First and second side parts 114, 116 are arranged respectively to the first and second sides 142*a*, 144*a* of the first tube member 102. Preferably, the first and second side parts 114, 116 are arranged in the upper end of the first tube member. The upper end is preferably the upper half of the first tube member, more preferably the upper ⅓ of the first tube member and most preferably the upper ¼ of the first tube member. The connection points for the first and second side parts may be reinforced. In use, the first and second side parts 114, 116 are supported respectively against a first and a second surface. Preferably, the first and second side parts are supported against the thighs of the user. The user may be seated while supporting the side parts against his/her thighs. Preferably, the ab exercise device is used for performing seated crunches.

The first and second side parts may be rotatable so that the movement direction is adjustable. This has been illustrated in FIGS. 2*a*-2*c*. In FIG. 2*a*, the device is tilting forwards. In FIG. 2*b*, the device is straight. In FIG. 2*c*, the device is tilting backwards. For example, in FIG. 2*a*, the device is tilted away from the user, and in FIG. 2*b* the device is tilted towards the user. Preferably, the side parts are rotating freely. The first and second side parts 114, 116 may comprise first and second side pads 115, 117 that are suitable for supporting against the thighs of the user. The side parts may be detachable.

The height of the exercise device in its upper position with the top part in its upper position is preferably 600-1000 mm, more preferably 700-900 mm and most preferably 760-800 mm. In one preferable embodiment the height of the device in its upper position is 780 mm. The height of the top part is adjustable by preferably 100-300 mm. The height of the exercise device in its lower position is preferably 350-550 mm, more preferably 400-500 mm and most preferably 430-470 mm. In one preferable embodiment the height of the device in its lower position is 450 mm.

Referring also to FIGS. 5*a-c*, the first elastic member 106 attaches to a first and second attachment point 118*a*, 120*a* on the outside of the first tube member 102. The first and second attachment points 118*a*, 120*a* are preferably located on the opposite sides of the first tube member 102.

Figure 3:
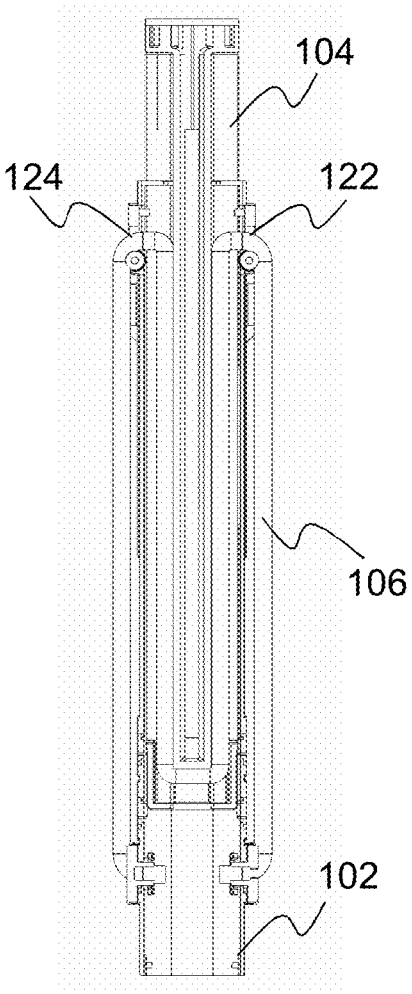
FIG. 3 illustrates a cross-section of an embodiment of the first and second tube members in accordance with the present invention.

Referring also to FIG. 3, the first elastic member 106 perforates the first tube member 104 a first and a second time on higher locations than the attachment points 118*a*, 120*a*. The first tube member comprises a first and second hole 122, 124 such that the elastic member 106 may perforate the tube. Alternatively, the elastic member 106 may go around the upper edges of the first tube member 102.

Figure 4:
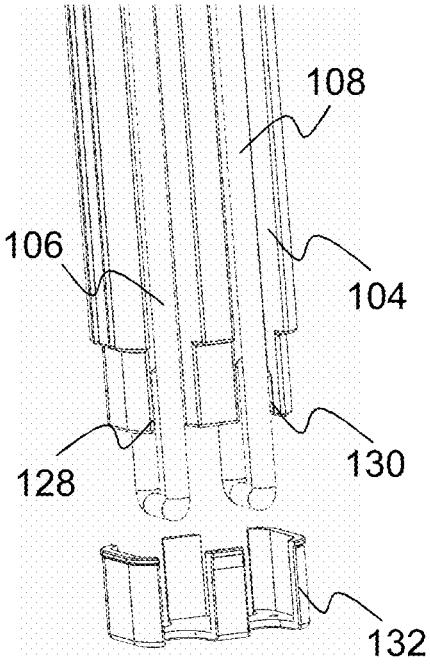
FIG. 4 illustrates an embodiment of the lower end of the second tube member in accordance with the present invention.

Referring also to FIG. 4, the elastic member 106 perforates the second tube member 104 in its lower end. The lower end is preferably the lower half of the second tube member, more preferably the lower ⅓ of the tube member and most preferably the lower ¼ of the tube member. Alternatively, the elastic member may go around the lower end of the second tube member 104.

The exercise device 100 comprises a second elastic member 108. The second elastic member is preferably substantially parallel to the first elastic member 106. The second elastic member 108 attaches similarly as the first elastic member from its first and second end to a first 126*a* and second (not in figure) attachment point. Alternatively, the exercise device comprises more than two elastic members. Some embodiments may only comprise one elastic member. The elastic members are preferably resistance bands. The elastic members may be arranged such that they are not facing the user. The first and second elastic members 106, 108 attach to the first and second side 142*a*, 144*a* of the first tube member 102.

Alternatively, the elastic member is a spring. The spring may be arranged within the first tube member, underneath the second tube member, for example.

Referring to FIG. 4, the lower end of the second tube member 104 comprises two grooves 128, 130 for the elastic members 106, 108. The second tube member comprises an end cover 132 for securing the elastic members 106, 108 to the second tube member.

Referring to FIGS. 5*a*-5*c*, the exercise device 100 comprises first and second attachment points on different heights such that the resistance of the elastic member can be adjusted. In a preferable embodiment, the exercise device comprises attachment points on three different heights.

The exercise device 100 comprises three first attachment points 118*a*-118*c* and three second attachment points 120*a*-120*c* for the first elastic member 106. Similarly, the exercise device 100 comprises three first attachment points 126*a*-126*c* and three second attachment points (not in figure) for the second elastic member 108.

The second attachment points are, preferably, substantially on the opposite side of the tube with respect to the first attachment points. The lowest attachment points give most resistance. The resistance can be reduced by moving the elastic members upwards. Respectively, the resistance is increased by moving the elastic members downwards.

The attachment points comprise plugs 134 for attaching/detaching the elastic members. In FIG. 5*a* the plug 134 is in a closed position and the resistance band 106 is locked in place. In FIG. 5*b*, the plug 134 is rotated to an open position such that the resistance band 106 may be detached from the attachment point. In FIG. 5*c*, the plug 134 and the first elastic member 106 is detached from the attachment point. The attachment points that are not in use may comprise caps 136 for safety.

Referring to FIGS. 6*a* and 6*b*, the exercise device 100 comprises a top part 110 for pressing down the second tube member. The top part may form a planar surface such that the user may place his/her arms on top of the top part. The top part 110 comprises a handle 138 comprising a first and a second loop respectively on a first and a second side of the device.

Consequently, a skilled person may on the basis of this disclosure and general knowledge apply the provided teachings in order to implement the scope of the present invention as defined by the appended claims in each particular use case with necessary modifications, deletions, and additions.

The invention claimed is:

1. An ab exercise device comprising:

a first tube member;

a second tube member movable in a downward movement and an upward movement with respect to the first tube member;

a resistance band configured to provide a resistance to the downward movement of the second tube member and configured to move the second tube member in the upward movement with respect to the first tube member;

a first and a second side part configured for supporting the ab exercise device respectively against a first and a second surface of a user, the first and the second side part being arranged respectively to a first and a second side of the first tube member in an upper end of the first tube member; and a top part configured for pressing the second tube member in the downward movement with respect to the first tube member, wherein first and second ends of the resistance band are configured to be attached respectively to first and second attachment points on an outside of the first tube member, wherein the resistance band is configured to perforate the first tube member on higher locations on the first tube member than said first and second attachment points or the resistance band is configured to go around edges of the first tube member, and wherein the resistance band is configured to perforate or go around the second tube member in a lower end of the second tube member.

2. The ab exercise device according to claim 1, wherein the first and second sides of the first tube member are opposite one another, the first tube member further comprises opposite third and fourth sides, and the first, second, third and fourth sides of the first tube member form a first substantially rectangular shape, and wherein the second tube member has a second substantially rectangular shape comprising opposite first and second sides of the second tube member and opposite third and fourth sides of the second tube member.

3. The ab exercise device according to claim 2, wherein the first and second sides of each of the first and second tube members respectively form a longer side of the first and second substantially rectangular shapes.

4. The ab exercise device according to claim 1, wherein the resistance band is comprised of two individual resistance bands.

5. The ab exercise device according to claim 4, wherein the two individual resistance bands are arranged in parallel, the two individual resistance bands being respectively attached to the first and second sides of the first tube member.

6. The ab exercise device according to claim 1, wherein the first and second attachment points are a plurality of first and second attachment points, respectively, located on different heights on the outside of the first tube member such that the resistance can be changed.

7. The ab exercise device according to claim 6, comprising at least three first and second attachment points.

8. The ab exercise device according to claim 1, wherein the first and second side parts are configured to be rotatable such that a position of the user in a comfortable movement direction is adjustable.

9. The ab exercise device according to claim 1, wherein the first and second side parts comprise respectively a first and a second side pad configured for supporting against thighs of the user.

10. The ab exercise device according to claim 1, wherein the top part is rotatable such that the ab exercise device is configured for twisted ab movement.

11. The ab exercise device according to claim 1, wherein a height of the top part is adjustable.

12. The ab exercise device according to claim 1, wherein the top part forms a planar surface configured to enable arms of the user to be placed on top of the top part.

13. The ab exercise device according to claim 1, wherein the top part is a handle comprising a first and a second loop.

* * * * *